United States Patent [19]

Hoffman et al.

[11] Patent Number: 4,527,288

[45] Date of Patent: Jul. 9, 1985

[54] RADIOLOGY APRON HAVING A WAIST SUPPORT MEANS

[76] Inventors: Richard B. Hoffman, 73 Portugese Bend Rd.; Jonathan B. Po, 68 Portugese Bend Rd., both of Rolling Hills, Calif. 90274

[21] Appl. No.: 626,543

[22] Filed: Jun. 29, 1984

[51] Int. Cl.[3] ..... A41B 13/10

[52] U.S. Cl. ..... 2/48

[58] Field of Search ..... 2/48, 2.5, 51, 304, 2/312

[56] References Cited

U.S. PATENT DOCUMENTS

| | | | |
|---|---|---|---|
| 2,945,614 | 7/1960 | Wittmann, Sr. | 2/51 |
| 3,191,186 | 6/1965 | Robertson | 2/51 |
| 4,417,146 | 11/1983 | Herbert | 2/51 |

FOREIGN PATENT DOCUMENTS

| | | | |
|---|---|---|---|
| 1020284 | 12/1957 | Fed. Rep. of Germany | 2/51 |

*Primary Examiner*—Doris L. Troutman

*Attorney, Agent, or Firm*—Edward A. Sokolski

[57] ABSTRACT

A radiology apron having a radiation protective material such as lead incorporated therein has means for supporting part of the weight of the apron at the user's waist on a belt or the waist of trousers worn by such user. Such means may include a bracket which mounts on the belt or trousers with a hook onto which an eyelet attached to the apron is placed, may include a notched portion formed on the bracket onto which a bolt attached to the apron is placed or may include such a hook member integrally attached to the apron.

4 Claims, 12 Drawing Figures

RADIOLOGY APRON HAVING A WAIST SUPPORT MEANS

This invention relates to radiology aprons and more particularly to such an apron having not only means for support on the shoulders of the user but also the user's waist area to divide the load of the apron on the user's body.

Radiology aprons for protecting the user from ionizing radiation during medical fluoroscopy or other activities involving radiation are generally lined with lead. Most such aprons are supported on the user's shoulder which transmits most of the load to the region of the back and spine creating a substantial stress on the lower back of the user. This can cause serious back injury and presents an ongoing problem particularly for radiologist and others who must wear such aprons for many hours at a stretch.

Several attempts have been made to alleviate this condition. These include the modification of the apron so that it is formed in two pieces, one piece being suspended from the shoulders and the other piece being suspended from the waist with a wrap around belt, strap or the like. Such two piece aprons generally have a combined weight which is greater than a standard one piece apron and are quite cumbersome to use. Other attempts to alleviate the situation involve the use of a diagonal belt or strap which is attached to the waist area of the apron and is tightened around the user's waist in an attempt to support part of the weight at the waist area. Such belts tend to loosen up after a time and thus do not reliably afford the desired support, returning most if not all of this load to the shoulders and hence to the lower back and spine.

The device of the present invention overcomes the aforementioned shortcomings of the prior art in providing a simple economical means of reliably supporting a substantial portion of the load of a radiology apron on the waist area of the user. This transmits the weight of the apron to the hips and legs instead of the spine. The device of the present invention can be supported on a regular belt used for supporting the users trousers, on the waist of the user's trousers, or on a special belt provided.

Briefly described the device of the present invention comprises a bracket member formed from first and second opposing arm means which fits over the users trouser belt, the waist of the users trousers or over a special belt provided for this purpose on which the bracket is thus supported. Means are provided on the bracket, for removable attachment in certain embodiments and permanent attachment in another embodiment, to a portion of the waist area of the radiology apron. Such attachment means in one embodiment comprises a hook member which extends from the bracket and which fits through an eyelet mounted on the apron; in another embodiment comprises a notch member extending from the bracket member into which a bolt attached to the apron is fitted; or may comprise a portion of the bracket which is fixedly attached to the apron by stitching, cementing or other suitable means.

It is therefore an object of this invention to alleviate the load placed on the shoulders of a user by a radiology apron.

It is a further object of this invention to provide simple and economical means for supporting a substantial portion of the load of a heavy radiology apron at the waist area of the user.

Other objects of this invention will become apparent as the description proceeds in connection with the accompanying drawings of which:

Figure 3:
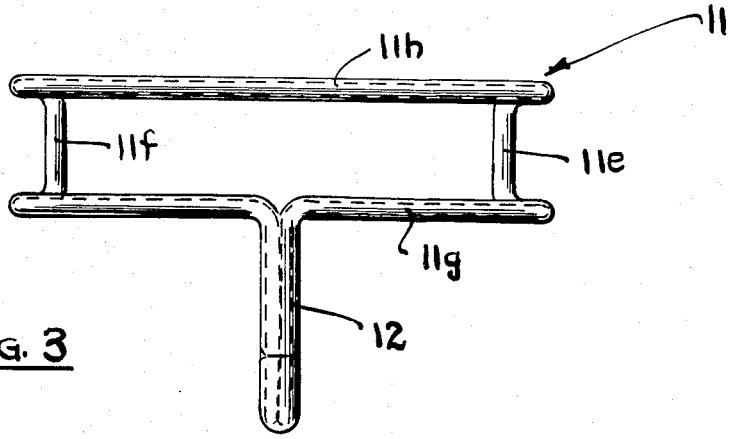
FIG. 3 is a bottom plan view of the bracket and hook member of FIG. 2.
Figure 2:
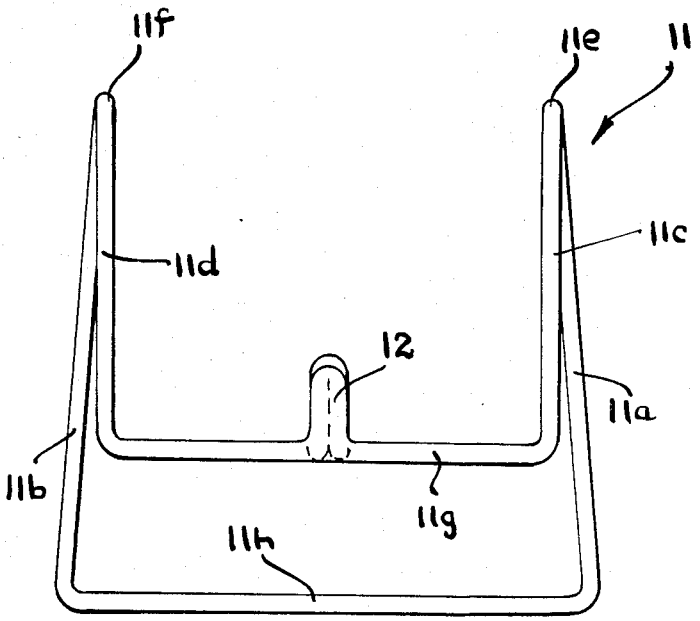
FIG. 2 is a perspective view of the bracket and hook member of the first embodiment.
Figure 4:
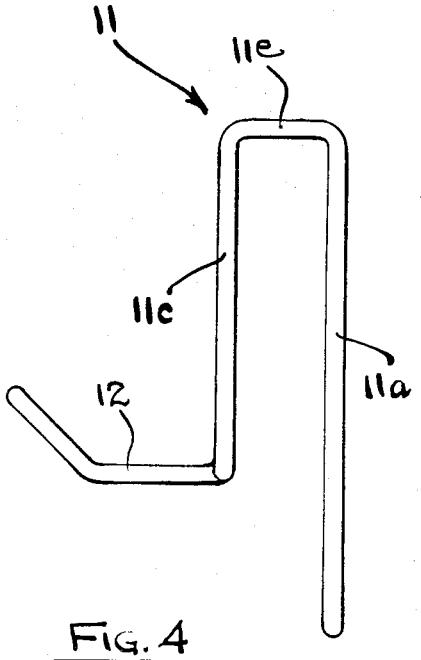
FIG. 4 is a side elevational view of the bracket and hook member of FIG. 3.

Referring now to FIGS. 2–4 the bracket and hook members of a first embodiment of the invention are illustrated. Bracket member 11 has a pair of opposing longer arms 11*a* and 11*b* which are separated from each other and joined together by cross-arm 11*h*. Arms 11*a* and 11*b* are joined to shorter opposing arms 11*c* and 11*d* respectively by cross members 11*e* and 11*f* respectively, the shorter arms 11*c* and 11*d* being substantially parallel to their opposing longer arms 11*a* and 11*b* respectively. A cross arm 11*g* joins the bottom ends of shorter arms 11*c* and 11*d* together with hook member 12 extending from cross arm 11*g* at substantially the center thereof. The bracket and hook assembly may be fabricated of a suitable resilent wire material which may be coated with plastic if so desired or may be fabricated entirely of a resilent plastic or other appropriate material.

Figure 1:
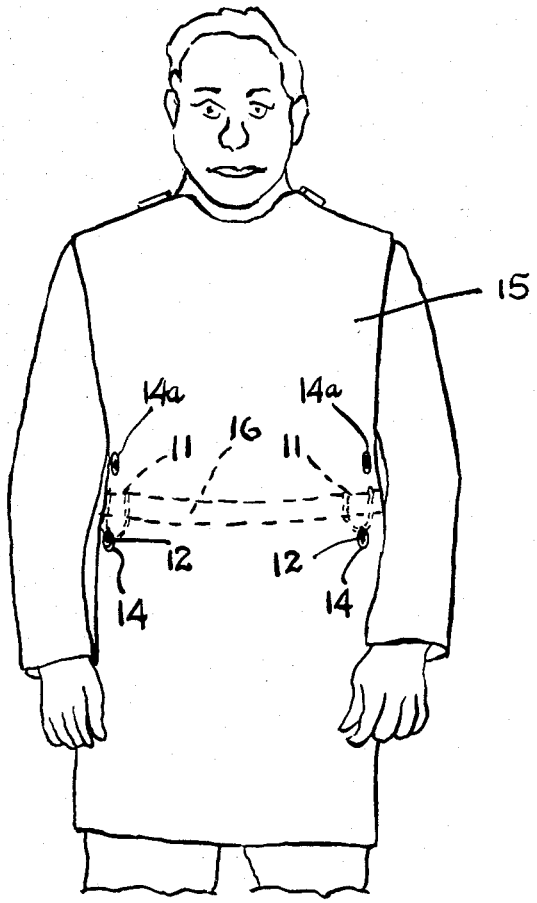
FIG. 1 illustrates a first embodiment of the invention in use.
Figure 5:
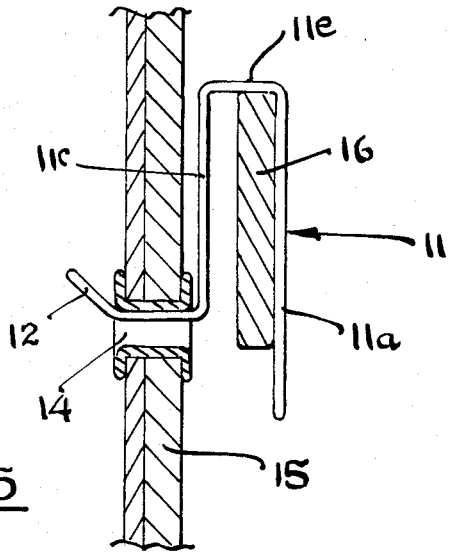
FIG. 5 is a side elevational view illustrating the hook member of FIG. 2 in use in supporting a radiology apron.
Figure 7:
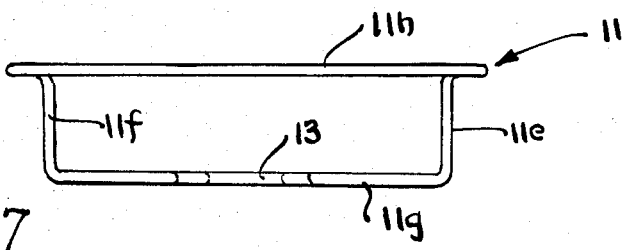
FIG. 7 is a bottom plan view of the bracket member of FIG. 6.
Figure 6:
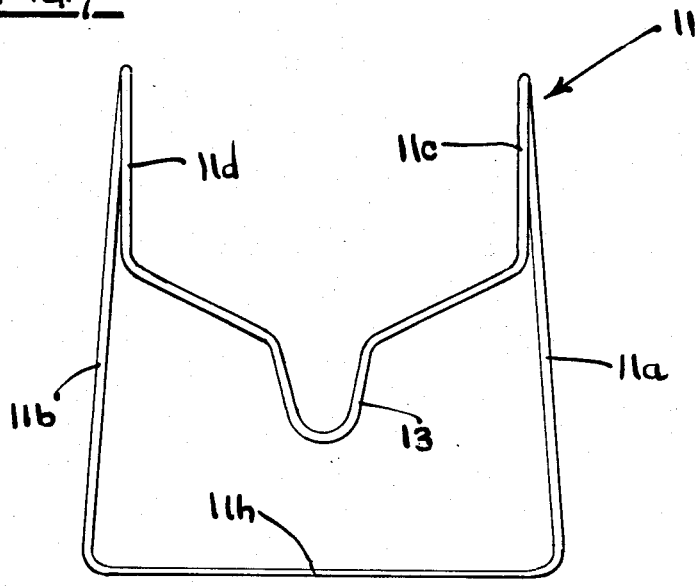
FIG. 6 is a front elevational view of a second embodiment of the bracket member of the invention.
Figure 8:
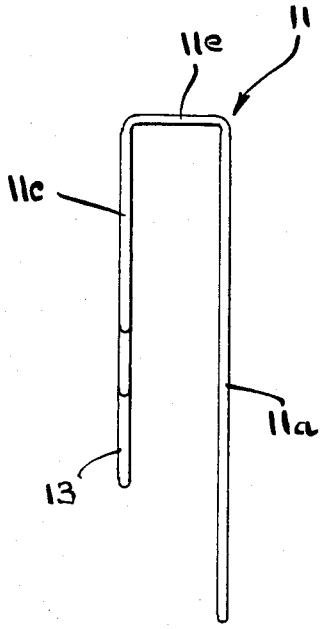
FIG. 8 is a side elevational view of the bracket member of FIG. 6.
Figure 9:
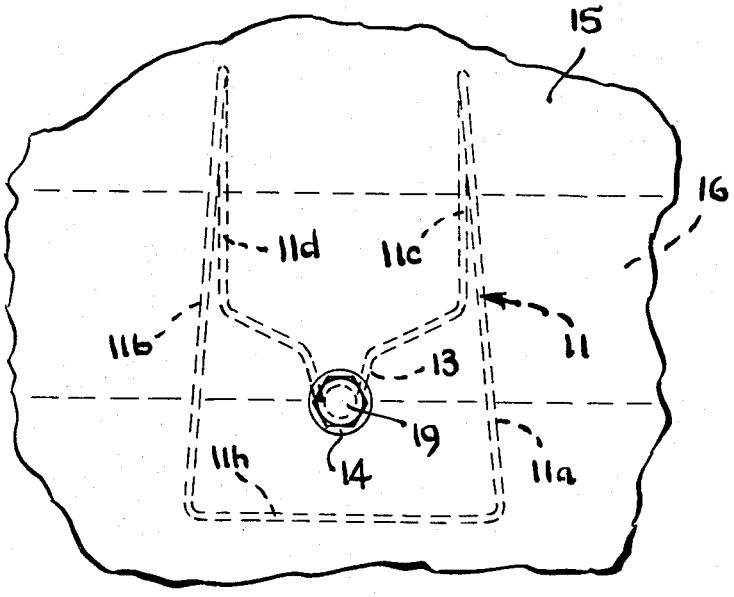
FIG. 9 is a front elevational view illustrating the bracket member of FIG. 6 in use in providing support for a radiology apron.
Figure 10:
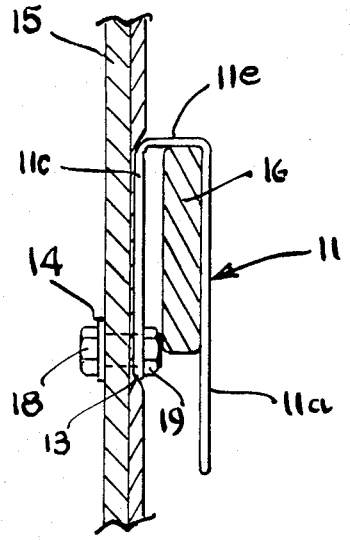
FIG. 10 is a side elevational view illustrating the bracket member of FIG. 6 in use supporting a radiology apron.

Referring now to FIGS. 1 and 5, the bracket and hook assembly is illustrated in combination with radiology apron 15, as being used to support a portion of the load of this apron. Bracket 11 is fitted over and supported on the user's belt 16. A pair of eyelets 14 are fixedly attached to apron 15 with a pair of the bracket and hook assemblies being employed to support the apron with hooks 12 fitted through eyelets 14. The apron thus is partially supported on the user's shoulders by means of the shoulder straps 15*a* and 15*b* of the apron and partially on the user's waist by means of brackets 11. Additional sets of eyelets 14*a*, etc. may be provided to accommodate persons of different heights.

Referring now to FIGS. 6–10 a second embodiment of the invention is illustrated. In this embodiment, the bracket member 11 is substantially the same as that of the first embodiment. In lieu of the hook, however, a notch member 13 is employed in the assembly and this notch member engages a bolt 18 which is fitted through eyelet 14 in apron 15. Also, to enable the formation of the notch, shorter arms 11*c* and 11*d* are made to converge towards each other. Bolt 18 is retained in place on the apron 15 by means of a nut 19, there being a space left between the nut and the apron to facilitate the installation of notch 13 over bolt 18. As for the previous embodiment the bracket 11 is placed over belt 16 (or the waist portion of the user's trousers). Bolt 18 is then installed in the notch so as to place a portion of the load of the apron on the bracket. It is to be noted in this regard that the eyelets 14 must be placed high enough on the apron so that the load of the apron is placed on the bracket.

Figure 11:
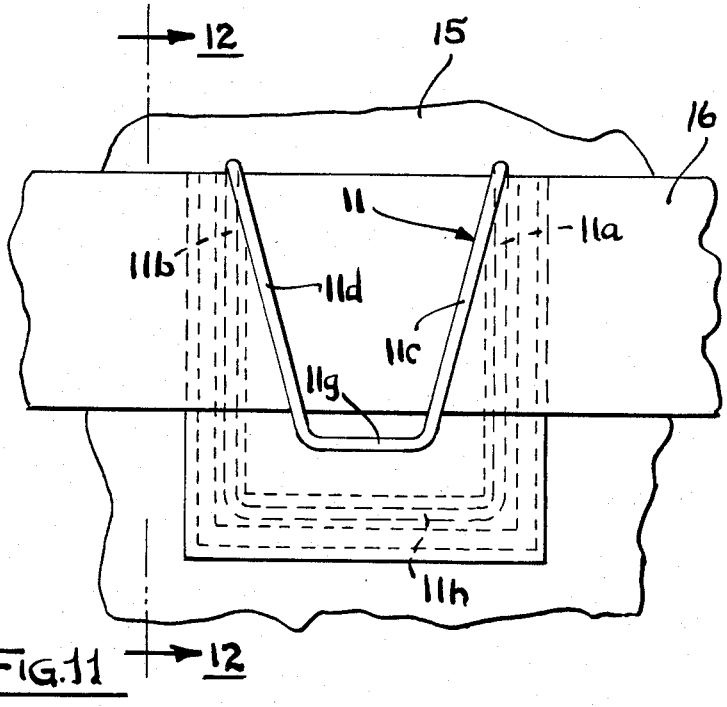
FIG. 11 is a front elevational view illustrating a third embodiment of the invention in use.
Figure 12:
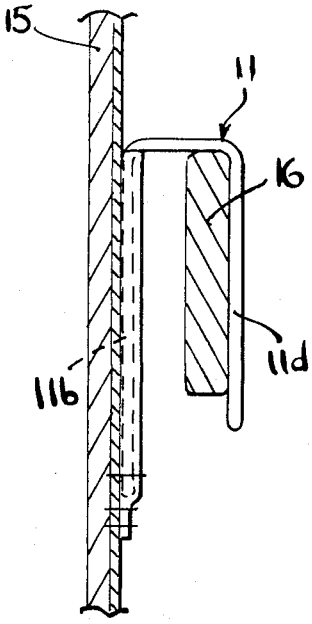
FIG. 12 is a cross sectional view taken along the plane indicated by 12—12 and FIG. 11.

Referring now to FIGS. 11 and 12 a further embodiment of the invention is illustrated. This embodiment employs a bracket member 11 which is similar to that of the previous embodiments and which is installed over the belt 16 (or in the waist area of the trousers) of the user. In this embodiment however the bracket 11 is permanently installed in the apron as by stitching, cementing or other suitable means.

The device of the invention thus provides simple yet highly effective means for distributing the load of a radiation apron between the shoulder and waist areas of the user, thereby relieving some of the load from the shoulder area and spine.

While the invention has been described in detail, it is to be clearly understood that this is intended by way of illustration and example only and it not to be taken by way of limitation, the spirit and scope of the invention being limited only by the terms of the following claims.

We claim:

1. In a radiology apron for protecting the user thereof from ionizing radiation said apron having shoulder straps for supporting the apron on the user's shoulders, the improvement being means for supporting a portion of the weight of said apron on the waist area of the user comprising;

a bracket having first and second arm means spaced from each other in opposing relationship;

means retained on the body of the user in the general waist area of such user for receiving said first arm means in retention thereon; and means for retaining said apron to said second arm means at a position thereon whereat a portion of the load of said apron is transferred to said bracket said retaining means comprising an eyelet installed in the apron and forming an aperture extending through the apron from one side to the other thereof, and a hook attached to the second arm means and extending outwardly therefrom, said hook being fitted through the aperture formed in the eyelet.

2. The device of claim 1 wherein said means retained on the body of said user in the waist area of such user comprises a belt encircling the user's waist.

3. The device of claim 1 wherein said first arm means comprises first and second oppositely positioned arm members join together by a third arm member said first, second and third arm members all being located in a common plane, said second arm means comprising fourth and fifth oppositely positioned arm members joined together by a sixth arm member, said fourth, fifth and sixth arm members being located in a common plane parallel to and opposite the plane of said first, second and third arm members, means for joining said fourth arm member to said first arm member and said fifth arm member to said second arm member, the means for retaining the apron to the second arm means comprising attachment means extending from said sixth arm member, and means on said apron for receiving said attachment means in retention thereto.

4. The device of claim 1 and further including a second bracket similar to the first bracket for supporting a portion of the load of said apron at a different location around the waist of the user than that at which said first bracket supports the load.

* * * * *